United States Patent [19]

Erb et al.

[11] 4,161,282

[45] Jul. 17, 1979

[54] MICROCAPILLARY NEBULIZER AND METHOD

[76] Inventors: Elisha W. Erb, 444 Main St., Fitchburg, Mass. 01420; Darrel R. Resch, 18 Campbell Ave., Leominster, Mass. 01453

[21] Appl. No.: 879,165

[22] Filed: Feb. 21, 1978

Related U.S. Application Data

[63] Continuation-in-part of Ser. No. 821,374, Aug. 4, 1977, which is a continuation-in-part of Ser. No. 718,647, Aug. 30, 1976, abandoned.

[51] Int. Cl.[2] ..... B05B 17/04

[52] U.S. Cl. ..... 239/8; 239/434; 239/496; 128/194

[58] Field of Search ..... 239/5, 8, 338, 405, 239/418, 419.5, 424, 424.5, 425.5, 426, 429–431, 434, 496, 497; 128/193, 194

[56] References Cited

U.S. PATENT DOCUMENTS

| | | | |
|---|---|---|---|
| 619,834 | 2/1899 | Schulke | 239/426 X |
| 1,436,351 | 11/1922 | Metcalf | 239/407 |
| 1,437,201 | 11/1922 | Schumann | 239/431 |
| 2,213,522 | 9/1940 | Holmboe et al. | 239/434 |
| 2,354,151 | 7/1944 | Skoglund | 239/431 X |
| 2,599,422 | 6/1952 | Yettaw | 239/431 X |
| 2,906,089 | 9/1959 | Kadosch et al. | 239/434 X |
| 2,993,652 | 7/1961 | Curry | 239/388 |
| 3,421,692 | 1/1969 | Babington et al. | 239/426 X |
| 3,473,530 | 10/1969 | Urbanowicz | 128/194 |
| 3,774,842 | 11/1973 | Howell | 239/25 |

FOREIGN PATENT DOCUMENTS

| | | | |
|---|---|---|---|
| 559913 | 8/1957 | Belgium | 239/496 |

*Primary Examiner*—Robert W. Saifer
*Attorney, Agent, or Firm*—Thomas L. Tully

[57] ABSTRACT

A pneumatic microcapillary nebulizer adapted to accept a supply of flowable liquid, such as water, and reduce the liquid to an ultrafine dispersion of particles in a propellant gas, such as air. The microcapillary nebulizer comprises a mixing element having a liquid conduit comprising a microporous capillary element having a multiplicity of liquid passages and exit orifices, a gas conduit having a gas orifice and a filming-surface having an edge comprising said gas orifice and communicating with said liquid exit orifices. All the liquid flowing to said filming surface must pass through said capillary element wherein it is retained in the absence of external forces and whereby it may be rendered substantially free of undesirable solid impurities of microscopic size or larger. The filming surface has an affinity for the liquid, which affinity coupled with the cohesive forces acting on the liquid and the pressure acting on the liquid, cause the liquid to flow out of the capillary element and across the filming surface to form a continuous thin liquid film on the filming surface which is drawn to the edge of the filming surface comprising the gas orifice and is reduced to an ultrafine dispersion of said liquid in the gas flowing through said gas conduit.

45 Claims, 7 Drawing Figures

MICROCAPILLARY NEBULIZER AND METHOD

BACKGROUND OF THE INVENTION

This application is a continuation-in-part of the copending application, Ser. No. 821,374, filed Aug. 4, 1977, which is a continuation-in-part of Ser. No. 718,647, filed Aug. 30, 1976, now abandoned.

Application Ser. No. 821,374, relates to pneumatic nebulizers which contain a filming surface between the narrow exit orifices of the liquid passages and the gas conduit. The exit orifices are so small as to retain the liquid therein by capillary attraction unless a force is applied, such as a pressurized liquid supply or a vacuum beyond the exit orifice, to force the liquid out of the exit orifices and onto the filming surface. The liquid has an affinity for the filming surface which is contiguous with the exit orifices of the liquid passages, which affinity causes the liquid to spread over the filming surface as a very thin continuous liquid film which flows to the edge of the filming surface and is drawn into the gas flow. The flowing gas shatters the liquid film and disperses it as an ultrafine dispersion of particles of liquid in the gas flow. The disclosure of the aforementioned application, Ser. No. 821,374, is incorporated herein by reference.

Prior pneumatic nebulizers have encountered two different problems, both related to the presence of solid impurities in the liquid being nebulized. Firstly, if the nebulizer is of the type having a limited number of very fine or narrow liquid passages and exit orifices, such passages and/or orifices can become contaminated and blocked with deposits of solid impurities, such as minerals, rust and/or dirt dispersed in the water or other liquid being nebulized. This causes the nebulizers, such as humidifiers, to malfunction and requires that they be disassembled due to blockage of the liquid passages and/or orifices, cleaned and/or replaced in cases where the liquid passages and/or orifices cannot be cleared or where corrosion has occurred.

Secondly, if the nebulizer is used in hospitals or other areas where a sterile atmosphere free of microbiological contamination must be maintained, it is essential that the ultrafine dispersion emitted by the nebulizer be sterile, i.e., free of germs and other solid impurities, even those which are microscopic in size. Such requirement is most important in the case of nebulizers used for the direct inhalation of ultrafine dispersions of liquid medicines by seriously ill patients having little or no resistance to the inhalation of germs or other solid impurities. This requirement is also important in a wide variety of other locations where the exclusion of germs, microbiological organisms and other solids dispersed in the atmosphere is essential, such as humidifiers used in hospital nurseries, incubators, burn units, operating rooms, intensive care units and medical research facilities.

Precautions are currently taken to avoid the introduction of germs and other solid impurities into atmospheres which are intended to be maintained sterile. Thus gases, such as air, are filtered and liquids, such as water, are sterilized and filtered in an effort to remove germs and other impurities. Sterilization by means of heat can be effective in killing germs, but filtration is necessary to remove the dead germs since the presence of foreign solids, such as dead germs, can be detrimental to the healing and recovery of the patient. A variety of filters are currently used for these purposes, including microporous membrane filters commercially available from Millipore Corporation, Bedford, Mass. and having means pore sizes ranging down to as small as 25 nanometers (0.025 micrometer).

While such procedures are effective in producing sterile supplies of liquids and gases, such liquids and gases can become recontaminated with germs, microbiological organisms and/or foreign substances when they are introduced into a nebulizer, such as a humidifier or an inhalation device. Even though precautions are taken to maintain such machines or devices clean, it is difficult to exclude all contamination. Even the presence of tiny amounts of minute contaminants can be critically important.

SUMMARY OF THE INVENTION

The present invention relates to a novel pneumatic microcapillary nebulizer which comprises a mixing element for introducing a supply of liquid through a liquid conduit having a multiplicity of microporous liquid passages and exit orifices, onto a filming surface having an affinity for said liquid to film the liquid for introduction into a gas flow which reduces the film of liquid into an ultrafine dispersion. The mixing element comprises a liquid conduit, a microporous element comprising a multiplicity of capillary liquid passages and exit orifices of said liquid conduit, and a filming surface which communicates with said microporous element and has an edge thereof closely spaced from said microporous element and communicating with the orifice of a gas conduit. In cases where a sterile atmosphere is required, the gas conduit may also be provided with a microporous element so that both the liquid on the filming surface and the gas supplied against the edge of said filming surface are filtered of all solid impurities, including those which are microscopic in size.

The dimensions of the present nebulizer device, including the pore sizes of the microporous capillary element are such that liquid will not flow from said microporous capillary element onto said filming surface under the effects of the forces acting on the liquid, unless the combined effect of such forces other than capillary force, exceeds the force due to the capillary attraction which tends to retain said liquid within the pores of the microporous capillary element. However, when a pressure differential is created, such as by opening a valve between a pressurized liquid supply and said liquid passage or by applying suction or a vacuum external to the microporous capillary element, liquid is caused to flow through the capillary element onto the filming surface where it lays down as a continuous thin film which is drawn to the edge of the filming surface where it meets the gas flowing through the gas conduit. The thin liquid film is drawn into the gas flow from the edge of the filming surface and shattered to form an ultrafine dispersion of the liquid in the gas.

Essentially, the nebulizer devices and methods of the present invention are the same as those of our aforementioned application Ser. No. 821,374 with the exception that the present capillary liquid passages and exit orifices of the liquidsupplying conduit comprise a myriad of capillaries present within a relatively uniform microporous element having an open cell structure, i.e., being permeable to said liquid under operating conditions. Thus, rather than relying upon the narrow spacing between two discs to provide the liquid passages and their exit orifices, or upon a limited number of coplanar recesses impressed or scratched into the surface of a disc, the present invention employs a microporous capillary element containing a myriad of pores therethrough which may communicate with each other and which are open at the surfaces of said element in the form of capillary exit orifices. Such elements can be manufactured to provide a multitude of uniform pores of any desired microscopic size and are commercially-available, such as from the Millipore Corporation, as discussed supra. Different capillary sizes are required for different liquids having different surface tensions and viscosities and also for different filtering properties in cases where filtration of the liquid is required.

DETAILED DESCRIPTION

Figure 1:
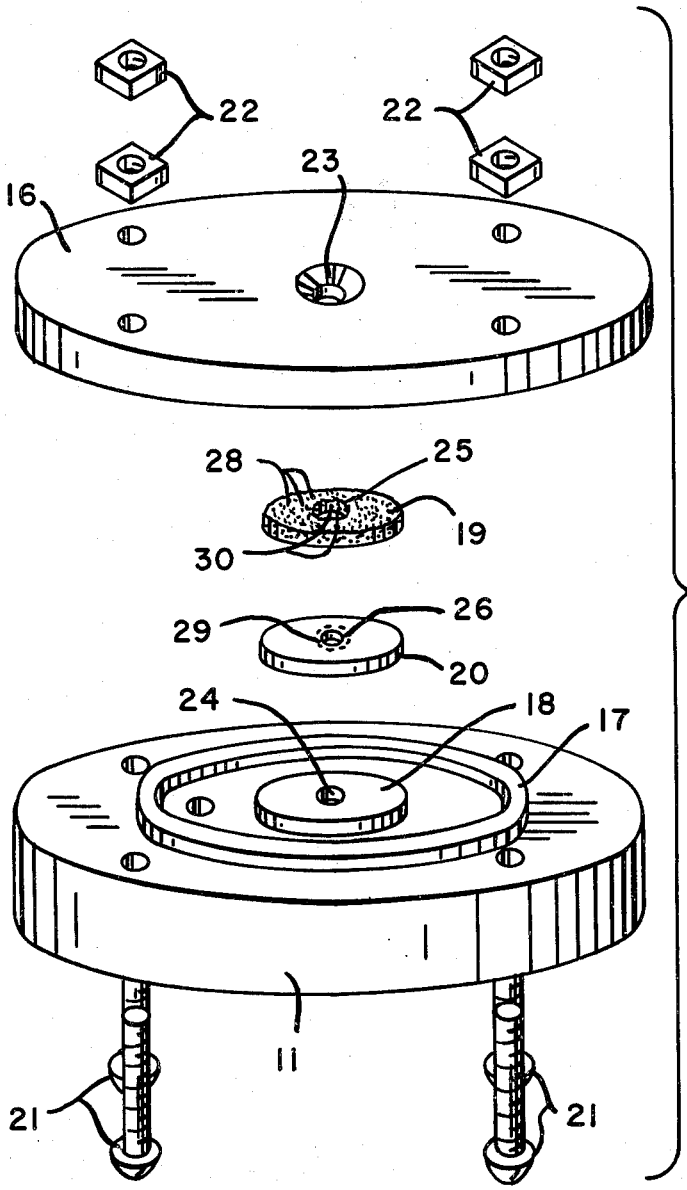
FIG. 1 is a perspective view of a nebulizer assembly according to one embodiment of the present invention, the elements thereof being shown spaced for purposes of illustration.

Capillary nebulizers, such as those of the present invention and those of our aforementioned parent application Ser. No. 821,374, cause a liquid, such as water, to be filmed and dispersed in a propellant gas, such as air, in the form of a continuous and uniform, stable, ultrafine dispersion having the appearance of a natural fog and containing the liquid in the form of particles having a geometric mean diameter of less than about 3 microns. This is accomplished by subjecting the liquid to three different, yet cooperative, forces which cause the liquid to flow from its container, to be drawn into the thinnest possible continuous film and to be dispersed in the propellant gas as an ultrafine dispersion, an equilibrium being established between the rate of supply and dispersion of said liquid, which equilibrium is not affected by gravity, vibration or other external forces.

The nebulizers of our parent application, as well as those of the present invention comprise a mixing element having thin liquid passages adapted to convey liquid therethrough as a thin liquid stream, and capillary liquid orifices or exits from said liquid passages opening onto a filming surface. The mixing element also comprises a propellant gas orifice which is an edge of said filming surface, sufficiently spaced from said liquid orifice that the thin liquid stream which exits said liquid orifices and adheres to said filming surface is caused to flow over said filming surface, forming a continuous film of the liquid which is even thinner than the thin liquid stream which exits the liquid orifices and which reaches its thinnest possible, yet continuous, state at the edge of the filming surface which comprises the gas orifice. At this point, the thin liquid film is drawn into the flow of propellant gas flowing through the gas passage which comprises the gas orifice.

The three separate forces acting upon the liquid in the nebulizer devices of the parent application and of the present invention are (1) sufficient pressure on the liquid up stream (behind) the liquid orifice to overcome the capillary forces which retain the liquid within the liquid passage(s) and/or the liquid orifice(s) thereof to force the liquid out of the liquid orifices; (2) adhesive force between the liquid and filming surface, which adhesive force causes the liquid exiting the liquid orifices to adhere to and spread over the filming surface; and (3) cohesive force which (a) causes the thin liquid film to retain its continuity as the liquid is drawn over the filming surface, and (b) also causes the liquid being removed from the edge of the filming surface at the gas orifice into the flow of propellant gas to draw to the edge of the filming surface liquid on the filming surface. An equilibrium is established between the rate at which the liquid is supplied to and removed from the filming surface to maintain liquid on the filming surface in the form of a continuous film extending from the liquid orifices to the gas orifice. The thinnest possible continuous film on the filming surface produces the finest possible uninterrupted fog and such a state of preferred equilibrium can be attained by either reducing the rate of the liquid supply or increasing the rate of the gas flow until the liquid film breaks as evidenced by a cessation or pulsation of fog emission. Thereafter, the liquid supply rate is increased slightly or the gas supply rate is reduced slightly until continuous fog emission resumes.

If the exceedingly thin liquid film is drawn from the filming surface into the gas flow substantially simultaneously with the dispersion of said gas flow into a large receptacle or open space, the expansion of the gas disperses the thin liquid film as fine particles and prevents the fine particles of liquid from coalescing into large droplets.

The present invention resides in the discovery of a novel means for providing capillary liquid passages and exit orifices for pneumatic nebulizers of the general type disclosed in our aforementioned parent application, Ser. No. 821,374, which novel means has the advantages of (a) providing a myriad of random, interconnected, capillary liquid passages and exit orifices which provide alternate liquid routes when portions thereof become blocked with solid impurities carried by the liquid; (b) being available in different known capillary sizes to provide precise filtering properties where desirable, and (c) being interchangeable and replaceable if necessary or desirable.

Small liquid exit orifices are essential to the present nebulizers because capillary force tends to hold the liquid in the liquid passages, if the exit orifices are very small, until the combined pulling and pushing effects of the various other forces acting on the liquid exceeds the capillary force. The smaller the liquid exit orifices, the greater the capillary force, and consequently, the greater must be the combined pulling and pushing effects of the various other forces acting on the liquid to draw-push liquid out of the liquid orifices. The force required to cause liquid to flow out of the very small, capillary liquid orifices can be greater than the net effect of the combined push and pull on the liquid in the liquid passages and orifices resulting from (a) the cohesive force which draws the liquid across the filming surface; (b) the adhesive force which draws the liquid onto the filming surface; (c) the gravitational force on the liquid in the liquid passages and orifices; and (d) the differences between the liquid pressure behind the liquid orifices and the ambient pressure at the mouth of the liquid orifices. When the strength of the capillary force retaining the liquid in the small liquid passages and orifices is greater than the net effect of the combined push-pull effect on the liquid in the liquid passages and orifices of the adhesive force, the cohesive force, gravity and the difference in pressure—the liquid will not flow out of the liquid orifices. As a consequence, it is possible by use of sufficiently small liquid exit orifices to supply liquid to the filming surface at an adjustable stable very low rate of flow regardless of the drawing power of the cohesive force, and/or regardless of the drawing power of the adhesive force, and/or regardless of the ambient pressure at the mouth of the liquid orifice by simply controlling the rate at which liquid is supplied to the liquid passages at a sufficient pressure to force the liquid therethrough. This would not be possible—i.e., supplying liquid to the filming surface at an adjustable stable low rate of flow by simply regulating the rate at which liquid is supplied to the liquid passages and exit orifices—if the liquid exit orifices were not critically small as defined herein. This is because if the liquid exit orifices were not critically small and liquid was supplied thereto at a controlled low rate, the cohesive force between the liquid being removed from the filming surface at the gas orifice and the liquid film on the filming surface, which cohesive force draws liquid from the liquid orifices across the filming surface to the gas orifice, in conjunction with the adhesive force, and for downward sloping liquid orifices—in conjunction with gravity, would draw liquid out from within the interior of the liquid passages, i.e., tunneling into the liquid orifices. As liquid is supplied to the liquid orifices at a controlled low rate, liquid would be drawn from the mouth of the liquid orifices faster than liquid was supplied to the liquid orifices until the interior of the liquid orifices had been emptied for some distance within the liquid passages and the liquid ceased flowing out of the liquid orifiees. Thereafter, liquid flowing into the liquid passages at the controlled low rate would refill the liquid orifices and ultimately cause liquid to flow out of the liquid orifices onto the filming surface. When the liquid on the filming surface contacted the gas flowing from the gas orifice, the liquid on the filming surface would be drawn into the gas flow, re-establishing the drawing force between the liquid being removed from the filming surface and the liquid on the filming surface, starting the cycle again. The end result is the pneumatic nebulizer operated in pulses.

The fact that for critically small capillary liquid orifices, liquid may be supplied to the filming surface at an adjustable low rate of flow which is steady and continuous regardless of the orientation in space of the liquid orifices or the strength of the adhesive and cohesive forces, makes it possible to set the rate of flow to less than the rate at which the cohesive force between the liquid being removed at the gas orifice and the liquid remaining on the filming surface is capable of drawing liquid from the liquid orifices. This rate differential makes it possible to stretch the liquid on the filming surface to a stable stretched exceedingly thin liquid film.

It is critical to the invention described herein that the liquid orifices be sufficiently small so that the net push-pull effect of the various forces acting on the liquid in the liquid orifices, other than capillary force, can be adjusted to be less than the capillary force, i.e., can be adjusted to stop the liquid flow at the mouth of the liquid orifices. The critical dimensions of the liquid orifices for any particular application depends on the relationship between the size of the liquid orifices and the strength of the capillary force, the strength of the pulling effect on the liquid in the liquid orifices of the cohesive force which draws the liquid across the filming surface, the strength of the pulling effect on the liquid in the liquid orifices of the adhesive force between the liquid and the filming surface, the positive or negative strength of gravitational force along the axis of the liquid orifices and the positive or negative strength of the difference between the pressure in the liquid behind the liquid orifices and the ambient pressure at the mouth of the liquid orifices.

An additional consequence of the liquid exit orifices being sufficiently small so that the net push-pull effect of the various forces acting on the liquid in the liquid exit orifices, other than capillary force, can be adjusted to be less than the capillary force, is that pneumatic nebulizers based on the within invention may be operated in any direction, such as straight down, and will also operate under vibration. Because the liquid orifices of pneumatic nebulizers based on the within invention are of critical size as defined herein or smaller, liquid will not flow from the liquid orifices at a rate greater than the controlled supply rate. This fact, in conjunction with the fact that the adhesive force between the liquid and the filming surface causes the liquid on the filming surface to adhere to the filming surface, prevents liquid from dripping from the pneumatic nebulizer regardless of its orientation in space or vibration, so long as the liquid supply rate does not exceed the rate at which liquid is removed from the filming surface by the gas flow.

The present invention is based upon the discovery that the size requirements for the liquid exit orifices of pneumatic nebulizers of the general type disclosed by our aforementioned application Ser. No. 821,374 are satisfied conveniently and most beneficially by the use of a microporous member or filter of the type which is commercially-available for ultrafine or microscopic filtration purposes. Such members are available in the form of sheets or membranes of various thicknesses, as thin as from about 125 to about 150 μm, and comprising a skeletal network or sponge system of pure, biologically-inert cellulose esters or various other polymeric materials containing an interconnected capillary pore system extending therethrough in all directions. They are available in a variety of different precise mean pore sizes ranging down to about 0.025 μm and have high porosity, with as much as about 84% of their volume consisting of pores. They have high degrees of permeability permitting high flow rates with respect to liquids and gases. They also have excellent retention or filtration properties for solid particles carried by the liquids or gases being passed therethrough, the minimum size of the solid particles being retained thereby being determined by the mean pore size of the particular microporous member selected. The microporous members consist of a myriad of pores per square inch of surface area which may be interconnected so that a large number of solid particles or impurities can be retained or trapped at the entrances of the pores passing through the member without substantially reducing the flow rate of the liquid or gas being passed therethrough due to the availability of a myriad of alternate random passages throughout the thickness of the member.

Figure 2:
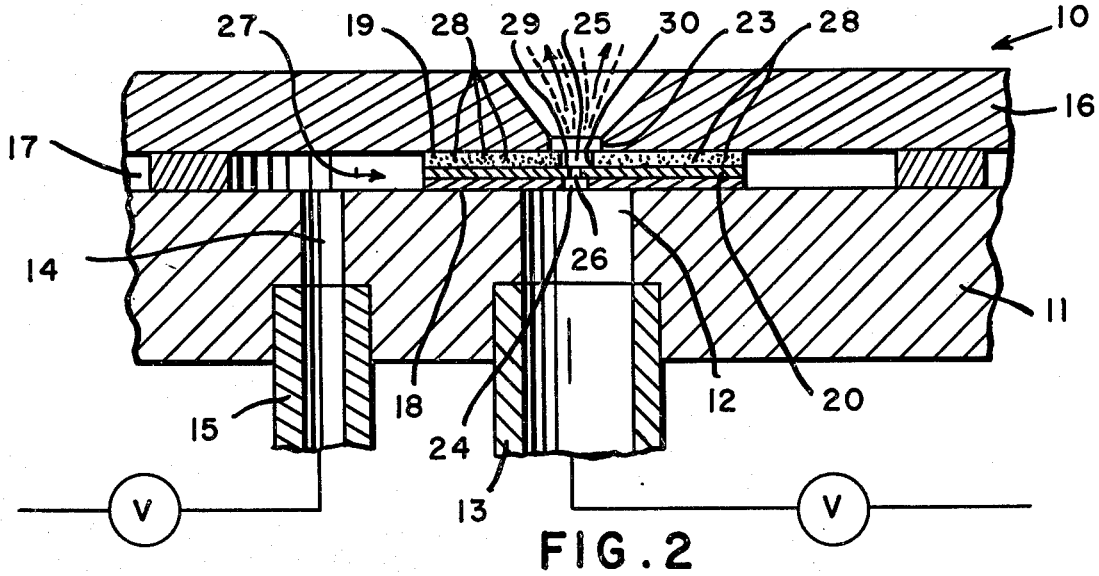
FIG. 2 is a diagrammatic partial cross-section of the nebulizer device of FIG. 1, illustrating the elements in magnified assembled position and in operation.

FIGS. 1 and 2 of the drawing illustrate a unitary nebulizer device adapted to be connected by valve means to adjustable sources of a liquid and a gas to cause atomization of the liquid in the form of an ultrafine stable fog. The device 10 comprises a circular base plate 11 having a central opening 12 adapted to be connected to a pneumatic conduit 13 and having an offset opening 14 connected to a liquid-supply tube 15. The base plate 11 is sealingly connected to a circular top plate 16 by means of a compressible outer ring gasket 17 and a compressible inner washer gasket 18 which sealingly confines between itself and the undersurface of top plate 16 circular microporous disc 19 and circular filming disc 20. Four bolts 21 and nuts 22 unite plates 11 and 16 with an adjustable pressure, due to the compressibility of gaskets 17 and 18. The plates 11 and 16 and gasket 18 are provided with central openings 12, 23 and 24 respectively, and the discs 19 and 20 are also provided with central openings 25 and 26, the latter being smaller in diameter than openings 23, 24 and 25, and forming a restricted sharp-edged gas orifice through which the gas from the pneumatic conduit 13 must pass. Hole 25 in the microporous disc 19 is substantially larger in diameter than hole 26 in filming disc 20. The liquid which passes through the pores 28 in microporous disc 19, which pores comprise the myriad of capillary liquid passages, exits through the numerous small liquid exit orifices 30, which comprise the pores exposed at central opening 25. The liquid exits onto the filming surface 29 of lower disc 20 within hole 25 of top disc 19 and lays down as a thin layer on surface 29 in the center of disc 20, shown by broken lines, as it is drawn to the edge of the filming surface at central opening 26 which comprises a restriction in the gas conduit.

All five central openings are coaxial in the assembled device to form a gas-flow passage. The flow of the gas through the most restricted orifice 26, which is the gas orifice, causes the gas to form a vena contracta at a distance beyond orifice 26 equal to approximately one-half the diameter thereof, and then to expand in a pattern as illustrated by FIG. 2.

As illustrated, the sealed confinement of gaskets 17 and 18 between plates 11 and 16 provides a circular chamber 27 to which liquid supplied to the device through supply tube 15 has access.

The circular discs 19 and 20, with their aligned central openings 25 and 26, have conforming surfaces which lie in sealing engagement with each other. Upper microporous disc 19 is provided with a myriad of uniform pores which form liquid passages located between the filming disc 20 and the undersurface of top plate 16, which passages or pores have entrances at the periphery of disc 19 and communicate with the central opening 25 of disc 19 by means of numerous liquid exit orifices 30 which exit into the central opening 25 adjacent filming surface areas 29 of filming disc 20, shown by broken lines in FIG. 1 and also shown in FIG. 2.

Figure 6:
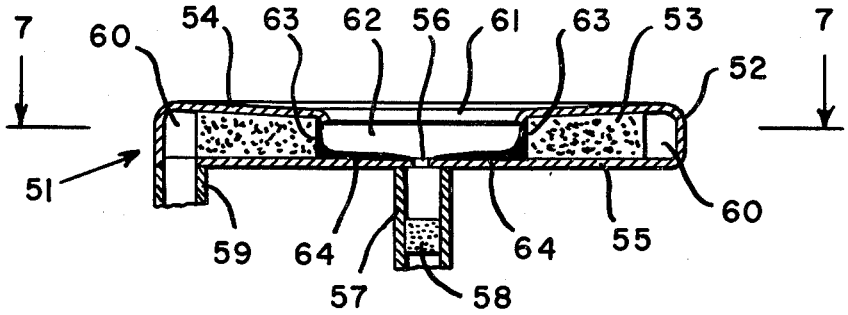

In operation, a gas is supplied through pneumatic conduit 13 so that it flows forcefully through openings 12, 24, 26, 25 and 23 and exits into the atmosphere, forming a vena contracta and an unobstructed flow pattern as shown by FIG. 2. A liquid is supplied at a controlled rate through supply tube 15 to circular chamber 27 where it is sealingly confined except for escape through the pores 28 of microporous disc 19, which pores comprise very narrow liquid passages or capillaries through disc 19, which passages have their exit orifices 30 at central disc opening 25. The pressure of the liquid provides a continuous supply of the liquid so that the microporous disc is saturated with the liquid and the liquid extends to and fills the exit orifices 30 adjacent the filming surface 29. As illustrated by FIG. 6, the liquid is attracted to receptive filming surface 29 in the area between the central openings 25 and 26 of the discs and forms a very thin film of the liquid having a thickness of less than 0.010 inch.

The thin liquid film covers surface 29 and extends to central gas orifice 26 where it is exposed to the blast of the gas flow from pneumatic conduit 13. The thin liquid film is immediately reduced to an ultrafine dispersion of liquid particles having a geometric mean diameter of about 3 microns or less which are carried through opening 25 by the propellant gas in the form of a stable fog as illustrated by FIG. 2. In the embodiment illustrated by FIG. 2, the thin liquid film enters the gas flow as the gas flow approaches its vena contracta and the liquid is reduced to the ultrafine dispersion. Thereafter, the gas expands in a pattern, as illustrated, and flows unobstructed into the atmosphere due to the chamfered structure of orifice 23 of the top plate 16. If orifice 23 is not chamfered, the gas flow might strike the inner surface of the orifice depending upon the gas pressure and the thickness of the plate 16. This would cause the dispersed liquid particles to wet said surface and flow back into orifice 25 and would also cause a vacuum to be created in orifice 23 above disc 19.

The filming disc 20 of FIGS. 1 and 2 is preferably formed of smooth stainless steel having a thickness of at least about 0.01 inch to prevent flexing of the disc. Because of the tight supporting contact between the discs 19 and 20 and plate 16, liquid is prevented from passing therebetween and must flow through the microporous disc 19.

It appears that the improved performance of the present nebulizer devices is due to a number of important cooperative features. First, the constant supply of the liquid through the myriad of uniform capillaries of the microporous disc 19 causes the liquid to exit from orifices 30 in the area of the central disc opening 25 at a uniform, constant rate, regardless of the accumulation of a substantial number of solid impurities in disc 19 or on its periphery, and causes the liquid to be drawn across filming surface 29 as a very thin filament or film of liquid having a thickness of from about 0.001 inch down to the smallest possible continuous thickness, from which condition the liquid is reduced to a multiplicity of extremely fine liquid particles at gas orifice 26.

A second cooperative feature of the present devices is the provision of a continuous gas flow at an angle to, preferably substantially perpendicular to, the direction of flow of the liquid film on filming surface 29, which gas flow passes through the central disc opening 26 and draws or pulls the thin liquid filament or film from surface 29 at the edges of central gas orifice 26 as an exceedingly thin liquid filament or film and disperses the liquid in the form of minute particles. Because the liquid film adjacent gas orifice 26 is exceedingly thin, it shatters when drawn into and struck by the gas flow, forming a multiplicity of microscopic liquid particles having a geometric mean diameter of less than about 3 microns which are carried along in the gas flow.

A third cooperative feature, according to a preferred embodiment, is the abrupt restriction in the gas flow provided by central orifice 26 in disc 20 which forms a sharp-edged gas orifice. The gas flow contracts as it flows from the wide area under disc 20 through the narrow area of hole 26 in disc 20. The gas flow continues to contract for some distance beyond disc 20. The point of greatest contraction is the vena contracta of the gas flow pattern and is shown in FIG. 2 as the most narrow portion of the illustrated gas flow pattern. The gas flow reaches its greatest velocity at this point and thereafter the gas flow pattern diverges. Because the gas flow carries away everything contacting it as it leaves gas orifice 26 in disc 20, a slight vacuum is created in the area of orifice 26 which helps the cohesive force between the departing liquid and the liquid on surface 29 draw or pull the thin liquid film towards orifice 26 and into the gas flow. The rate at which the liquid film is drawn over the filming surface 29 and into the gas flow will depend in part upon the characteristics of the liquid and in part upon the pressure under which the gas is forced through gas orifice 26 and in part upon the rate at which the liquid is supplied to liquid chamber 27 and through the microporous disc 19. The finest possible fog is produced by maintaining the rate of removal and the rate of supply of liquid to filming surface 29 at that equilibrium which results in an exceedingly thin continuous filament or film of liquid on surface 29 adjacent gas orifice 26. This is accomplished by supplying liquid through conduit 15 at a slow and steady rate and under slight, but sufficient, pressure to force a slow steady flow of liquid through the microporous disc 19 and out of orifices 30 at opening 25 onto filming surface 29 where the liquid can be drawn across surface 29 as a very thin filament or film by the cohesive forces between the liquid being removed from surface 29 at gas orifice 26 and the remaining liquid on surface 29 and by the suction created by the gas flow.

A fourth cooperative feature of the present devices, according to a preferred embodiment of the present invention, is the unobstructed passage of the liquid-particle-carrying gas flow into the atmosphere or into a larger chamber being supplied thereby. This is accomplished by excluding from the path of the gas flow any portion of the device which could be contracted by the diverging gas flow pattern. Thus, if the device has a top plate or other element beyond the central discs, which would normally be contracted by the expanding gas flow, the central orifice of such top plate or other element must be sufficiently large or the plate must be sufficiently thin or must be outwardly chamfered, as shown by FIG. 2, to prevent the gas flow from striking the surface of the plate or other element before it escapes into the atmosphere. If the expanding gas flow pattern strikes the surface of the plate or any other solid surface in the vicinity of the disc openings, the dispersed liquid particles will coalesce on that surface and increase in size until the surface becomes wet with the liquid and droplets form thereon. Many of said droplets will be blown off the surface on which they form by the flowing gas, thereby contaminating with relatively large droplets the fine dispersed liquid particles contained in the flowing gas. In addition, if the expanding gas flow pattern strikes the central orifice of the top plate, some of said droplets will run down the sides of the central orifice and onto disc 19, eventually entering central opening 25 and flooding the filming surface 29. This is a second source of large liquid particles in the gas flow because the liquid which enters in the area of the central disc opening 25 augments, and thereby makes thick, the thin liquid film on the filming surface 29, resulting in a flooding of gas orifice 26 and the formation of oversize droplets in the dispersion.

In some instances where the atmosphere being treated is itself contained within a confined receptacle, such as in the case of automobile carburetors, face masks, inhalation devices, etc., the advantages discussed above resulting from the unobstructed passage of the liquid-containing gas flow or fog must be compromised to some extent, but in all cases the liquid on the filming surface 29 is in the form of a very thin film having a thickness of less than 0.001 inch when the gas flow contacts the liquid at orifice 26. The gas then flows into a larger area so that the gas may expand for at least some distance to permit at least a substantial percentage of the fine liquid particles to become widely dispersed.

As discussed supra, the passage of the gas flow from a large space to a confined, narrow space as it passes from the space under disc 20 through the sharp-edged, restricted central opening 26 thereof and into the larger space in the area of opening 25, causes the formation of a vena contracta and then a substantial dispersement of the gas flow, with attendant reduction in gas pressure. The thin liquid film is drawn into the gas flow in the vicinity of the vena contracta. This causes the already-thin film of liquid to be torn apart by the fast moving gas in the vena contracta with resultant formation of exceptionally fine liquid particles to the apparent exclusion of liquid particles greater than about 20 microns in diameter and probably even to the exclusion of liquid particles greater than about 10 microns in diameter. The liquid particles are immediately dispersed by the expansion of the gas flow beyond the vena contracta. The emitted liquid dispersion has the appearance of a fine, stable fog.

It is an important requirement of the present invention that the gas flow be substantially continuous and of sufficient velocity that the liquid film be blown from the edge of filming surface 29 at orifice 26, causing liquid to be drawn at a regular uniform, rate across surface 29 from the exit orifices 30 of microporous disc 19.

Preferably, the gas and liquid supply are pressurized but this is not necessary in cases where there is a vacuum in the receptacle or atmosphere being treated such as in the case of an automobile manifold. The manifold vacuum creates a suction in the area of the gas orifice 26 and the liquid exit orifices 30, causing the gas, i.e., air, to be sucked through its orifice and causing the liquid, i.e., gasoline, to be sucked through its orifices and dispersed into the air flow for vaporization and perfect combustion.

Figure 3:
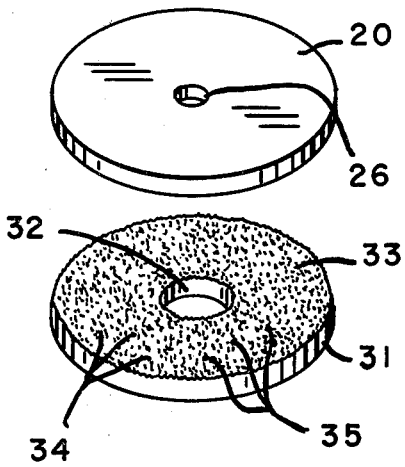
FIG. 3 is a perspective view of a unitary mixing element suitable for use in the nebulizer assembly of FIG. 1.

FIG. 3 illustrates another microporous disc 31 which may be substituted for disc 19 of FIGS. 1 and 2, disc 31 being illustrated with disc 20 in inverted position for purposes of illustration. Thus, filming disc 20 has a smooth upper-surface and a small central opening 26 comprising the gas orifice, while the microporous disc 31 has a larger central opening 32 and a microporous surface 33 comprising a multiplicity of interconnected pores 34 of uniform size and depth surrounded by a multiplicity of peaks or plateaus 35 of uniform height which comprise the microporous network. Such disc surfaces may be formed by sandblasting or otherwise chemically or mechanically etching the surface in a uniform and controlled manner whereby the original thickness of the disc is substantially retained in spaced areas of plateaus 35 surrounded by valleys or recessed areas comprising pores 34 which are interconnected and which extend from the periphery of the disc to the central orifice 32, as illustrated. Uniformly roughened surfaces of this type are receptive to liquids, due to their porosity and are particularly resistant to becoming clogged because of the myriad of liquid orifices which provide alternative routes or passages for the liquid. When the microporous surface 33 is pressed tightly against the smooth surface of lower disc 20, the surface pores 34 form liquid passages which have entrances at the outer periphery of disc 31 and exit orifices at central opening 32 onto the filming surface 29 of disc 20.

Suitable surfaces of this type may also be formed by pressing the disc against a die having an inversely-corresponding rough surface or, in the case of plastic discs, casting or molding the disc against a casting or molding surface having an inversely-corresponding rough surface. It should be noted that the filming surface 29, being that part of the upper surface of lower disc 20 lying between opening 32 in upper disc 31 and opening 26, need not be smooth. The cohesive force between the liquid being drawn into the gas flow and the liquid still present on the filming surface will draw the liquid across both rough or smooth surfaces.

As an alternative means for forming surface porosity on the present microporous members, it is possible to apply a discontinuous layer of suitable material in a thickness of 0.01 inch or less to the surface of the discs or plates rather than removing surface material from the discs or plates. The end result is similar in appearance and function to the disc 31 of FIG. 4, for instance, the raised areas 34 surrounding the shallow recessed areas or pores 35 being formed by applying a uniformly-thin discontinuous coating of inert material such as synthetic resin or metal to the smooth surface of the disc. This may be done using photosensitive resinous compositions which are exposed through a negative and then removed from the unexposed areas which will correspond to recessed areas 35, or by vacuum deposition of a metallic layer using a stencil to prevent deposition in the spaced areas which will correspond to recessed areas 35. The discontinuous coating may also be applied by speckle coating techniques where specks of suitable composition are sprayed onto the surface of the plate or disc to form a multiplicity of spaced peaks 34 of uniform height equal to 0.01 inch or less over the entire surface of the plate or disc. A similar result may be obtained by applying uniformly-sized particles of heat-fusible metal or plastic powder to the disc surface, such as by electrostatic techniques, and then heat-fusing or sintering the particles to each other and to the disc surface to form a microporous network. Other suitable methods will be apparent to those skilled in the art in the light of the present disclosure, the essential requirement being that the formed porosity is sufficiently fine to retain the particular liquid used therewith by capillary attraction.

Figure 4:
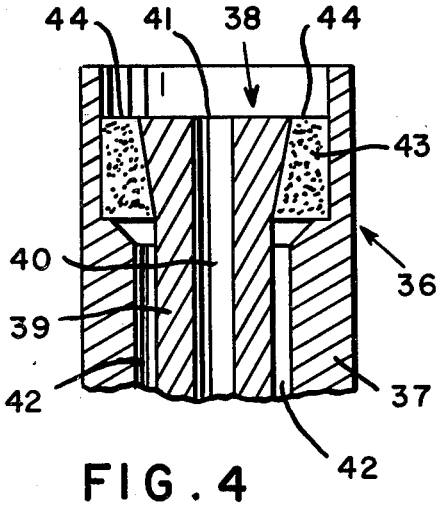
FIGS. 4, 5 and 6 are diagrammatic cross-sections of nebulizer-assemblies according to other embodiments of the present invention.
Figure 5:
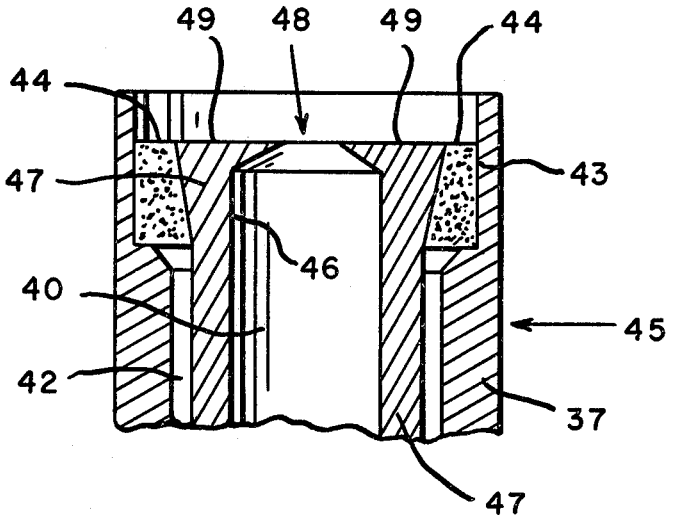

FIGS. 4 and 5 illustrate alternative designs for pneumatic nebulizers which are particularly adapted for oil burner use. Referring to FIG. 4, the nebulizer 36 thereof comprises an outer casing 37 which may be cylindrical. Within the outer casing 37 is an interior gas conduit or tube 39 having a gas passage 40 having an entrance communicating with a pressurized gas supply and having an exit at gas orifice 41. The outer diameter of tube 39 is sufficiently smaller than the inner diameter of casing 37 as to provide therebetween an annular space comprising a liquid passage 42 having an entrance communicating with a pressurized liquid supply and having an exit comprising an annular microporous capillary member 43 which functions as a liquid-permeable seal between casing 37 and gas conduit 39. Member 43 is similar to the microporous disc 19 of FIGS. 1 and 2 in that it consists of a relatively rigid skeletal network, such as a sintered bronze pellet filter, containing a myriad of interconnected pores which communicate with each other to form liquid passages which extend generally perpendicular to the plane of the filming surface and which open to the atmosphere at upper surface 44 in the form of a myriad of small liquid exit orifices adjacent to and generally on the same plane as the smooth, annular, flat filming surface 38 of the gas conduit 39. The upper surface 44 of the microporous member 43 is on the same plane as, or on a slightly higher plane than, the filming surface 38 so that liquid exiting member 43 at surface 44 is drawn towards the gas orifice 41 and forms a very thin film on the filming surface 38 for which it has an affinity. The gas flowing through passage 40 contacts the thin liquid film at the inner edge of the filming surface 38 at gas orifice 41 and reduces the liquid film to an ultrafine dispersion. The capillary properties of member 43 are such that the liquid will be retained therein, even if the nebulizer is turned upside down, unless the liquid is forced therefrom under pressure.

The nebulizer 45 of FIG. 5 is similar to that of FIG. 4 and identical numbers are used to identify identical elements thereof. Thus, it comprises an outer casing 37, which may be cylindrical, an interior gas conduit or tube, numbered 47 in FIG. 5, a gas passage 40, a liquid passage 42 and a microporous member 43 at the exit of the liquid passage 42 which opens to the atmosphere at upper surface 44 of the microporous member 43. The essential difference between the nebulizers of FIGS. 4 and 5 resides in the fact that the gas conduit or tube 47 has a restricted sharp-edged gas orifice 48 so that the filming surface 49 extends beyond the inner surface 46 of the gas conduit 47. The movement of the gas through the restricted gas orifice 48 produces a vena contracta in the gas flow, resulting in a greater shock to the liquid film at the upper edge of the filming surface 49 at orifice 48 and the production of a most ultrafine dispersion of the liquid in the gas.

In cases where the nebulizers of FIGS. 4 and 5 are used to produce sterile dispersions, member 43 should be a microporous member of sufficiently small pore size and a similar microporous member of sufficiently small pore size should be placed as an obstruction within the gas conduit 39 or 47 so that the liquid and the gas passing through each is cleansed of all dust, germs, microorganisms or other minute solid particles. Since the microporous members can have the required degree of uniform microscopic porosity and permit high flow rates, they may be located as described herein to provide any high degree of filtration of both liquid and gas immediately prior to the dispersion of the liquid in the gas, thereby minimizing solid contamination in either material.

The oil burner of FIG. 4 or FIG. 5 may be provided with a spaced baffle plate, combustion cone and/or exterior chimney element as illustrated by FIGS. 5 and 6 of our parent application, Ser. No. 821,374. Such elements permit the intake of additional atmospheric air for combustion purposes, shield the nebulizer and microporous member from the heat of the combustion, and improve the heat-radiation properties of the burner, as taught by said co-pending application.

Figure 7:
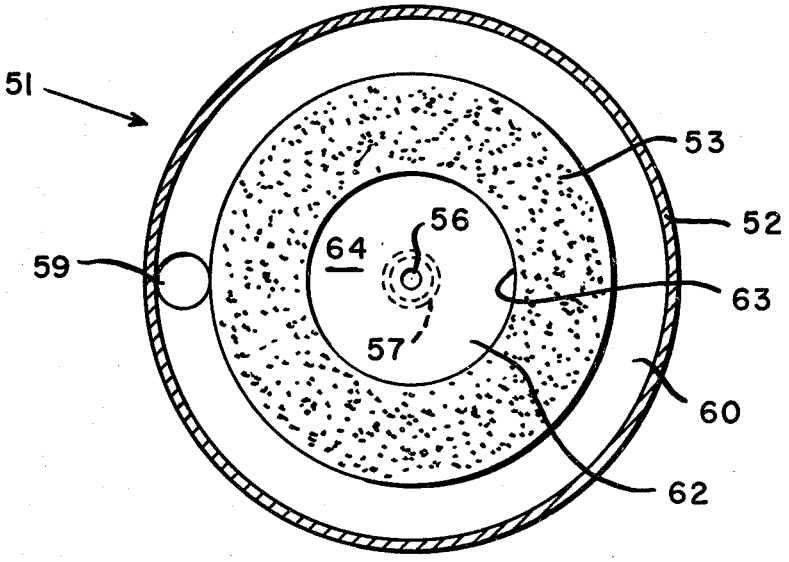
FIG. 7 is a view of the nebulizer of FIG. 6 taken along the line 7—7 thereof.

FIG. 6 and 7 illustrate a simplified, unitary nebulizer 51 which is adapted for single, throw-away use, if desired. Nebulizer 51 comprises a unitary metal or plastic casing 52 which sealingly confines a ring-shaped microporous element 53 in centered position between the top wall 54 and the bottom wall 55 thereof. The bottom wall 55 of the casing 52 is provided with a small central hole comprising a gas orifice 56 and with a downwardly-extending flange or short gas conduit 57 which has an inside diameter larger than gas orifice 56 and an outside diameter adapted to be tightly engaged by a flexible rubber hose which is connected to an adjustable pressurized gas supply. Also illustrated is the presence of an optional microporous, gas-permeable member 58 within gas conduit 57 adjacent gas orifice 56 which functions to filter the gas, such as air, passing therethrough in cases where such is necessary. Bottom wall 55 is also provided with a peripheral downwardly-extending flange or short liquid conduit 59 which opens into an annular space or liquid passage 60 which extends around the periphery of the microporous ring member 53 due to the fact that the outer diameter of centered member 53 is less than the inside diameter of casing 52, as shown in FIG. 7. Liquid conduit 59 has an outside diameter adapted to be tightly engaged by a flexible rubber hose connected to an adjustable pressurized liquid source. Finally, the top wall 54 of casing 52 is provided with a relatively large central hole 61 which is similar in size to the central hole 62 in the microporous member 53 and is bevelled downwardly adjacent said hole to provide a centering, restraint edge which engages the interior edge or exit orifice wall 63 of the ring-shaped microporous member 53 to maintain said member in centered position relative to the gas orifice 56.

The pneumatic nebulizer of FIGS. 6 and 7 functions in the same manner as those of FIGS. 2 and 5 in providing a gas flow which forms a vena contracta due to its passage through the sharp-edged, restricted gas orifice 56. When a pressurized liquid is supplied to the annular liquid passage 60 through liquid conduit 59, it fills passage 60 and impregnates the microporous member 53, being absorbed within all of the capillary passages extending therethrough. If the liquid supply is shut off at this point, the liquid will be retained within the microporous member 53 by capillary attraction and will not flow out onto the upper central surface or filming surface 64 of the bottom casing wall 55 even if the device is turned on end or upside down.

When the pressurized liquid supply is resumed and pressurized gas is supplied through gas conduit 57, filter 58 and orifice 56, the capillary restraint to the liquid flow is overcome and liquid flows out of the myriad of micropores or liquid exit orifices present at the interior wall 63 of the microporous member 53, said liquid being drawn over the filming surface 64, which has an affinity therefor, in the form of a very thin, continuous liquid film which becomes thinner as it is drawn towards the central edge of the filming surface comprising the gas orifice 56. The force of the filtered gas flow, as it approaches its vena contracta, blasts the thin liquid film into minute particles forming an ultrafine dispersion.

The present nebulizer devices, such as those of FIGS. 6 and 7, can be made exceptionally small in size and sufficiently inexpensive as to justify disposing thereof after a single use or a limited period of use, i.e., they may be used on sealed aerosol spray cans containing a liquid and a pressurized propellant gas. Since microporous members useful according to the present invention may be made at any desired size, it is clear that unitary nebulizer devices of the structure illustrated by FIGS. 6 and 7 can be made exceptionally small.

It should be understood that microporous members of various types, sizes and qualities may be used according to the present invention, depending upon the specific requirements. Such members are generally relatively rigid so as to resist compression and change in pore size but such is not a requirement where the member is mounted in fixed relaxed position within a casing or other container, provided that the member is sufficiently rigid to resist major distortion under the force of the pressurized liquid supply.

Biologically-inert microporous members of very small pore size, such as Millipore membrane filters, may be required for both the liquid supply and the gas supply where sterile dispersions are necessary, such as in inhalation therapy devices, hospital humidifier systems, incubators, etc. However, where filtration of the liquid is not required and the microporous member functions only to provide a myriad of liquid capillaries which offer capillary restraint against the flow or drawing of the liquid contained therein, in the absence of applied force, numerous other microporous materials may be used provided they are substantially inert to the particular liquids and gases used therewith and are heat-resistant, where necessary. Such materials include fine sponges, both natural and of the synthetic resin type, dense fabrics such as felt, heat-resistant, sintered metal as currently used to filter fuel oil in fuel burners, heat-resistant, porous ceramics as currently used in gasoline filters and any other inert microporous materials which provide capillary attraction for the particular liquids with which they are used.

An essential feature of the present invention is that the microporosity of the exit orifices of the microporous element or filter be sufficiently small or fine so that liquid is not drawn from the liquid exit orifice except as liquid is supplied to the liquid-saturated microporous element. That is, liquid is not drawn out from the interior of the microporous element because of the smallness or fineness of the liquid exit orifices. The net combined effects of the other forces acting on the liquid, in the absence of more liquid being supplied to the microporous member, are insufficient to overcome the capillary forces which restrain the liquid flow. Consequently, liquid does not flow from the liquid exit orifices onto the filming surface except as liquid is supplied to the microporous element. It is this essential feature—liquid flows onto the filming surface from the liquid exit orifices at the same steady rate at which more liquid is supplied to the liquid orifice—which makes it possible to supply a steady flow of liquid to the filming surface at a controlled low rate, which rate can be set to be less than the rate at which the cohesive force between the liquid being dispersed at the gas orifice and the liquid on the filming surface is capable of drawing liquid from the liquid orifice. The fact that the liquid may be supplied to the filming surface at a steady rate which is less than the rate at which the cohesive force between the liquid being dispersed at the gas orifice and the liquid on the filming surface is capable of drawing liquid from the liquid orifice makes it possible to stretch the liquid on the filming surface to a stable stretched exceedingly thin liquid film. This essential feature, in conjunction with the adhesive force between the liquid and the filming surface, permits pneumatic nebulizers based on the present invention to operate in any direction, such as straight down, and/or under vibration.

The controlled flow of liquid through the narrow liquid orifices can be achieved by any of a number of possible means which either control the pressure of the liquid upstream of the exit orifices relative to the ambient pressure at the mouth of the exit orifices or control the rate at which liquid of sufficient pressure is supplied to the exit orifices. The rate of flow of the liquid through the orifices may also be controlled entirely or in part by utilizing various sized orifices, provided, of course, they are sufficiently small as described above and the liquid's upstream pressure is sufficiently high.

It should be understood that the specific structure of the nebulizer devices set forth in the figures of the drawing are not critical except with respect to accommodating the present mixing elements and that variations will be apparent to those skilled in the art for purposes of simplification or modification of the devices to a particular use where size, shape, appearance or other factors are to be considered.

Variations and modifications may be made within the scope of the claims and portions of the improvements may be used without others.

We claim:

1. A nebulizer device capable of reducing a flowable liquid to an ultrafine dispersion of liquid particles in a propellant gas, comprising a mixing element comprising (a) a microporous member having a multiplicity of liquid passages therethrough, said passages having entrance orifices adapted to receive a supply of said flowable liquid and exit orifices sufficiently small that when filled with said liquid, the liquid is retained therein by capillary attraction and is prevented from flowing therefrom under ambient conditions except as liquid is supplied through said liquid passages to said exit orifices, (b) a filming surface communicating with said exit orifices and having some affinity for said liquid, and (c) a gas orifice comprising an edge of said filming surface spaced from said exit orifices and communicating with a gas conduit adapted to transmit a supply of gas through said gas orifice, whereby liquid which flows through said liquid passages is adapted to exit said exit orifices as thin liquid streams which adhere to said filming surface as a continuous thin liquid film which extends to the edge of said filming surface comprising said gas orifice where the thin liquid film is adapted to be drawn into the gas flowing through said gas passage, the drawing of said liquid film into said gas flow causing said film to be stretched across said filming surface as a very thin continuous film of said liquid for introduction into said gas flow to form said ultrafine dispersion.

2. A nebulizer device according to claim 1 in which said microporous member comprises a skeletal network of a solid material containing an interconnected pore system comprising said liquid passages.

3. A nebulizer device according to claim 2 in which said solid material is biologically-inert.

4. A nebulizer device according to claim 2 in which said solid material comprises a polymeric material.

5. A nebulizer device according to claim 4 in which said polymeric material comprises a cellulose ester.

6. A nebulizer device according to claim 2 in which said solid material comprises sintered particles of metal.

7. A nebulizer device according to claim 2 in which said solid material comprises a ceramic material.

8. A nebulizer device according to claim 1 in which said mixing element is a unitary element comprising said microporous member contained within a casing, a portion of said casing extending beyond said microporous element to form said filming surface.

9. A nebulizer device according to claim 1 in which said microporous member comprises a microporous disc or plate having a transverse opening with which said exit orifices communicate and which communicates with said filming surface.

10. A nebulizer device according to claim 1 in which said mixing element comprises said microporous member and a smooth member which is pressed thereagainst to form said filming surface.

11. A nebulizer device according to claim 1 in which the liquid passages of said microporous member extend in a direction generally perpendicular to said filming surface and said exit orifices are generally on the same plane as said filming surface.

12. A nebulizer device according to claim 1 in which said gas orifice comprises a restricted, sharp-edged orifice.

13. A nebulizer device according to claim 1 which further comprises means for controlling the rate of flow of the liquid through the exit orifices, predetermined variations in the rate of flow of said liquid causing various predetermined amounts of liquid to combine with said gas at the gas orifice to provide ultrafine dispersions having variable predetermined concentrations.

14. A nebulizer device according to claim 1 which further comprises means of controlling the rate of flow of the gas through the gas orifice, predetermined variations in the rate of flow of said gas causing various predetermined amounts of gas to combine with the liquid at the gas orifice to produce ultrafine dispersions having variable predetermined concentrations.

15. A nebulizer device according to claim 1 which further comprises means for maintaining the liquid upstream of said exit orifices at a sufficiently greater pressure than the ambient pressure at the outlet of said exit orifices to force liquid through said liquid passages and out of said exit orifices onto said filming surface.

16. A nebulizer device according to claim 1 in which said filming surface comprises a material which has good affinity for the particular liquid used therewith.

17. A nebulizer device according to claim 1 in which a microporous, gas-permeable member is present in said gas conduit to filter and remove microscopic impurities from the gas being supplied to the gas orifice.

18. A nebulizer device according to claim 1 comprising a fuel burner in which said microporous member comprises a heat-resistant material and said gas orifice communicates with a combustion chamber.

19. A nebulizer device capable of reducing a flowable liquid to an ultrafine dispersion of liquid particles in a propellant gas, comprising (a) a microporous member having a multiplicity of liquid passages therethrough, said passages having entrance orifices adapted to receive a supply of said flowable liquid and exit orifices sufficiently small that when filled with said liquid, the liquid is retained therein by capillary attraction and is prevented from flowing therefrom under ambient conditions except as liquid is supplied through said liquid passages to said exit orifices, (b) a liquid compartment communicating with said entrance orifices and adapted to supply a flowable liquid thereto, (c) a filming surface communicating with said exit orifices and having some affinity for said liquid, (d) a gas conduit having a gas orifice comprising an edge of said filming surface spaced from said exit orifices and adapted to transmit a supply of gas through said gas orifice, and (e) means for controlling the rate of flow of said liquid through said small liquid passages, whereby liquid which flows through said liquid passages at a controlled rate is adapted to exit said orifices as thin liquid streams which adhere to said filming surface as a continuous thin liquid film which extends to the edge of said filming surface comprising said gas orifice where the thin liquid film is adapted to be drawn into the gas flowing through said gas passage, the drawing of said liquid film into said gas flow causing said film to be stretched across said filming surface as a very thin continuous film of said liquid for introduction into said gas flow to form an ultra-fine dispersion containing variable predetermined amounts of said liquid and said gas.

20. A nebulizer device according to claim 19 in which said microporous member comprises a skeletal network of a solid material containing an interconnected pore system comprising said liquid passages.

21. A nebulizer device according to claim 20 in which said solid material is biologically-inert.

22. A nebulizer device according to claim 20 in which said solid material comprises a polymeric material.

23. A nebulizer device according to claim 22 in which said polymeric material comprises a cellulose ester.

24. A nebulizer device according to claim 20 in which said solid material comprises sintered particles of metal.

25. A nebulizer device according to claim 20 in which said solid material comprises a ceramic material.

26. A nebulizer device according to claim 19 comprising a unitary element including said microporous member contained within a casing, a portion of said casing extending beyond said microporous element to form said filming surface.

27. A nebulizer device according to claim 19 in which said microporous member comprises a microporous disc or plate having a transverse opening with which said exit orifices communicate and which communicates with said filming surface.

28. A nebulizer device according to claim 19 comprising said microporous member and a smooth member which is pressed thereagainst to form said filming surface.

29. A nebulizer device according to claim 19 in which the liquid passages of said microporous member extend in a direction generally perpendicular to said filming surface and said exit orifices are generally on the same plane as said filming surface.

30. A nebulizer device according to claim 19 in which said gas orifice comprises a restricted, sharp-edge orifice.

31. A nebulizer device according to claim 19 which comprises valve means for controlling the rate of flow of the liquid to the liquid compartment and through the exit orifices, predetermined variations in the rate of flow of said liquid causing various predetermined amounts of liquid to combine with said gas at the gas orifice to provide ultra-fine dispersions having variable predetermined concentrations.

32. A nebulizer device according to claim 19 which further comprises means of controlling the rate of flow of the gas through the gas orifice, predetermined variations in the rate of flow of said gas causing various predetermined amounts of gas to combine with the liquid at the gas orifice to produce ultrafine dispersions having variable predetermined concentrations.

33. A nebulizer device according to claim 19 which further comprises means for maintaining the liquid upstream of said exit orifices at a sufficiently greater pressure than the ambient pressure at the outlet of said exit orifices to force liquid through said liquid passages and out of said exit orifices onto said filming surface.

34. A nebulizer device according to claim 19 in which said filming surface comprises a material which has good affinity for the particular liquid used therewith.

35. A nebulizer device according to claim 19 in which a microporous, gas-permeable member is present in said gas conduit to filter and remove microscopic impurities from the gas being supplied to the gas orifice.

36. A nebulizer device according to claim 19 comprising a fuel burner in which said microporous member comprises a heat-resistant material and said gas orifice communicates with a combustion chamber.

37. Method for reducing a flowable liquid to an ultra-fine dispersion of liquid particles in a propellant gas comprising the steps of:

(a) confining a flowable liquid within a microporous element comprising a multiplicity of microscopic liquid passages having entrances communicating with a supply of liquid and having as the only means for escape a multiplicity of exit orifices sufficiently small that when filled with liquid, the liquid is retained therein by capillary attraction and is prevented from flowing therefrom under ambient conditions except as liquid is supplied to said exit orifices, (b) causing said flowable liquid to flow into said entrances, through said liquid passages and out of said exit orifices onto a filming surface having some affinity for said liquid whereby said liquid forms a thin continuous liquid film having a thickness of about 0.01 inch or less on said filming surface extending from said exit orifices to an edge of said filming surface which is spaced from said exit orifices, and (c) causing a supply of gas to flow at sufficient velocity through a gas orifice which communicates with said edge of said filming surface and against said continuous liquid film which extends to said edge, thereby causing said continuous liquid film to become stretched as a very thin continuous film of said liquid on said filming surface and to be drawn into said gas flow to form said ultra-fine dispersion.

38. Method according to claim 37 which comprises maintaining the liquid upstream of said exit orifices at a sufficiently greater pressure than the ambient pressure at the outlet of said exit orifices to force liquid through said liquid passages and out of said exit orifices onto said filming surface.

39. Method according to claim 37 which comprises controlling the rate of flow of said liquid through the liquid passages and their exits to cause various predetermined amounts of the liquid to combine with the gas at the gas orifice to produce ultra-fine dispersions having variable predetermined concentrations.

40. Method according to claim 37 which comprises controlling the rate of flow of said gas through the gas orifice, predetermined variations in the rate of flow of said gas causing various predetermined amounts of gas to combine with the liquid at the gas orifice to produce ultra-fine dispersions having variable predetermined concentrations.

41. Method according to claim 37 in which the said microporous element used functions to filter and remove impurities from the liquid being supplied through the microporous element.

42. Method according to claim 37 in which the gas is passed through a microporous gas-permeable member to filter and remove impurities therefrom prior to passage of said gas through said gas orifice.

43. Method according to claim 37 on which said gas orifice is a restricted, sharp-edged orifice and said gas forms a vena contracta into which the liquid film is drawn to form said ultra-fine dispersion.

44. Method according to claim 37 in which said ultra-fine dispersion is released directly into a larger receptacle without striking any solid surface.

45. Method according to claim 37 in which said liquid is a combustible liquid and said ultra-fine dispersion is released into a combustion chamber and ignited.

* * * * *

UNITED STATES PATENT AND TRADEMARK OFFICE

CERTIFICATE OF CORRECTION

PATENT NO. : 4,161,282

DATED : July 17, 1979

INVENTOR(S) : ELISHA W. ERB and DARREL R. RESCH

It is certified that error appears in the above-identified patent and that said Letters Patent are hereby corrected as shown below:

Column 2, line 59, "liquidsupplying" should be --liquid-supplying--; column 5, line 44, "operated" should be --operates--; column 7, line 50, "areas" should be --area--; column 16, line 63, "adapted to exit said orifices" should be --adapted to exit said exit orifices--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*